US008267509B2

(12) United States Patent
Sakano

(10) Patent No.: US 8,267,509 B2
(45) Date of Patent: Sep. 18, 2012

(54) INKJET RECORDING APPARATUS

(75) Inventor: Yuji Sakano, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 546 days.

(21) Appl. No.: 12/363,476

(22) Filed: Jan. 30, 2009

(65) Prior Publication Data

US 2009/0189967 A1 Jul. 30, 2009

(30) Foreign Application Priority Data

Jan. 30, 2008 (JP) ..... 2008-019664

(51) Int. Cl.
*B41J 2/01* (2006.01)

(52) U.S. Cl. ..... 347/104; 347/101

(58) Field of Classification Search ..... 347/104
See application file for complete search history.

(56) References Cited

U.S. PATENT DOCUMENTS

| | | | | |
|---|---|---|---|---|
| 6,808,259 | B2 * | 10/2004 | Rasmussen et al. | 347/104 |
| 7,036,923 | B2 * | 5/2006 | Takagi et al. | 347/104 |
| 2003/0142190 | A1 | 7/2003 | Rasmussen et al. | |
| 2005/0018029 | A1 | 1/2005 | Takagi et al. | |
| 2005/0195262 | A1 | 9/2005 | Takeda et al. | |
| 2006/0098074 | A1 | 5/2006 | Nakashima | |
| 2007/0035605 | A1 * | 2/2007 | Kitahara | 347/104 |
| 2009/0109254 | A1 * | 4/2009 | Satake et al. | 347/16 |

FOREIGN PATENT DOCUMENTS

| | | | |
|---|---|---|---|
| EP | 1582366 | A2 | 10/2005 |
| EP | 1733892 | A1 | 12/2006 |
| EP | 1790487 | A1 | 5/2007 |
| JP | H03-021458 | A | 1/1991 |
| JP | 2000-086010 | A | 3/2000 |
| JP | 2004-066450 | A | 3/2004 |
| JP | 2004-066540 | A | 3/2004 |

(Continued)

OTHER PUBLICATIONS

European Patent Office; European Search Report in Application No. 09001220.4 (counterpart to the above-captioned U.S. patent application) May 20, 2009.

(Continued)

*Primary Examiner* — Laura Martin
*Assistant Examiner* — Jeremy Bishop
(74) *Attorney, Agent, or Firm* — Baker Botts L.L.P.

(57) ABSTRACT

An inkjet recording apparatus includes: one or more inkjet heads each having an ejection surface having a plurality of ejection openings formed thereon; and a conveyor mechanism which has a facing region facing the one or more ejection surfaces, and conveys a recording medium placed on the region. The inkjet recording apparatus further includes one or more moving mechanisms. Each of the one or more moving mechanisms includes a medium pusher which pushes down a recording medium towards the region. The each of the one or more moving mechanisms causes the medium pusher to move between a first position and a second position. The first position is such a position where a distance between the medium pusher and the region is further than the distance between the region and the ejection surfaces. The second position is such a position where the medium pusher contacts the region.

8 Claims, 8 Drawing Sheets

FOREIGN PATENT DOCUMENTS

| | | | |
|---|---|---|---|
| JP | 2005-001203 | A | 1/2005 |
| JP | 2005-262862 | A | 9/2005 |
| JP | 2006-131353 | A | 5/2006 |
| JP | 2006-159644 | A | 6/2006 |
| JP | 2007-076109 | A | 3/2007 |
| JP | 2007-152785 | A | 6/2007 |
| WO | 2006120164 | A1 | 11/2006 |

OTHER PUBLICATIONS

Japan Patent Office; Notice of Reasons for Rejection in Japanese Patent Application No. 2008-019664 (counterpart to the above-captioned U.S. patent application) mailed Apr. 27, 2010.

* cited by examiner

INKJET RECORDING APPARATUS

CROSS REFERENCE TO RELATED APPLICATION

The present application claims priority from Japanese Patent Application No. 2008-19664, which was filed on Jan. 30, 2008, the disclosure of which is herein incorporated by reference in its entirety.

BACKGROUND OF THE INVENTION

1. Field of the Invention

The present invention relates to an inkjet recording apparatus which ejects ink towards a recording medium.

2. Description of the Related Art

Japanese Unexamined Patent Publication (Tokukai) 2006-131353 discloses an inkjet recording apparatus incorporating an inkjet head having an ejection surface with a plurality of ejection openings formed thereon, and a conveyor mechanism having an endless conveyor belt where a recording medium is placed, which conveyor mechanism conveys the recording medium. The inkjet head and the conveyor mechanism are provided to the inkjet recording apparatus in such a manner that the ejection surface and an upper surface of the conveyor belt face one another. Ink is ejected from the inkjet head towards the recording medium being conveyed by the conveyor mechanism to form an image on the recording medium.

SUMMARY OF THE INVENTION

The inkjet recording apparatus as described above may cause a recording medium to be attached to the ejection surface of the inkjet head when the recording medium is jammed between the inkjet head and the conveyor mechanism. If the recording medium is left under such a condition without being promptly removed for a long period of time, the recording medium may not be detachable from the ejection surface.

An object of the present invention is to provide an inkjet recording apparatus preventing a recording medium from being left attached to an ejection surface.

An inkjet recording apparatus includes: one or more inkjet heads each having an ejection surface having a plurality of ejection openings formed thereon; a conveyor mechanism which has a facing region facing the one or more ejection surfaces, and conveys a recording medium placed on the facing region; and one or more moving mechanisms each of which has a medium pusher pushing down a recording medium towards the facing region and causes the medium pusher to move between a first position and a second position. The first position is a position where a distance between the facing region and the medium pusher is farther than a distance between the facing region and the one or more ejection surfaces. The second position is a position where the medium pusher contacts the facing region.

According to the invention, when a recording medium is attached to the one or more ejection surfaces, the recording medium is detached from the one or more ejection surfaces by the one or more medium pushers, and is moved to the facing region of the conveyor mechanism. Thus, it is possible to prevent a recording medium from being left attached to the one or more ejection surfaces.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
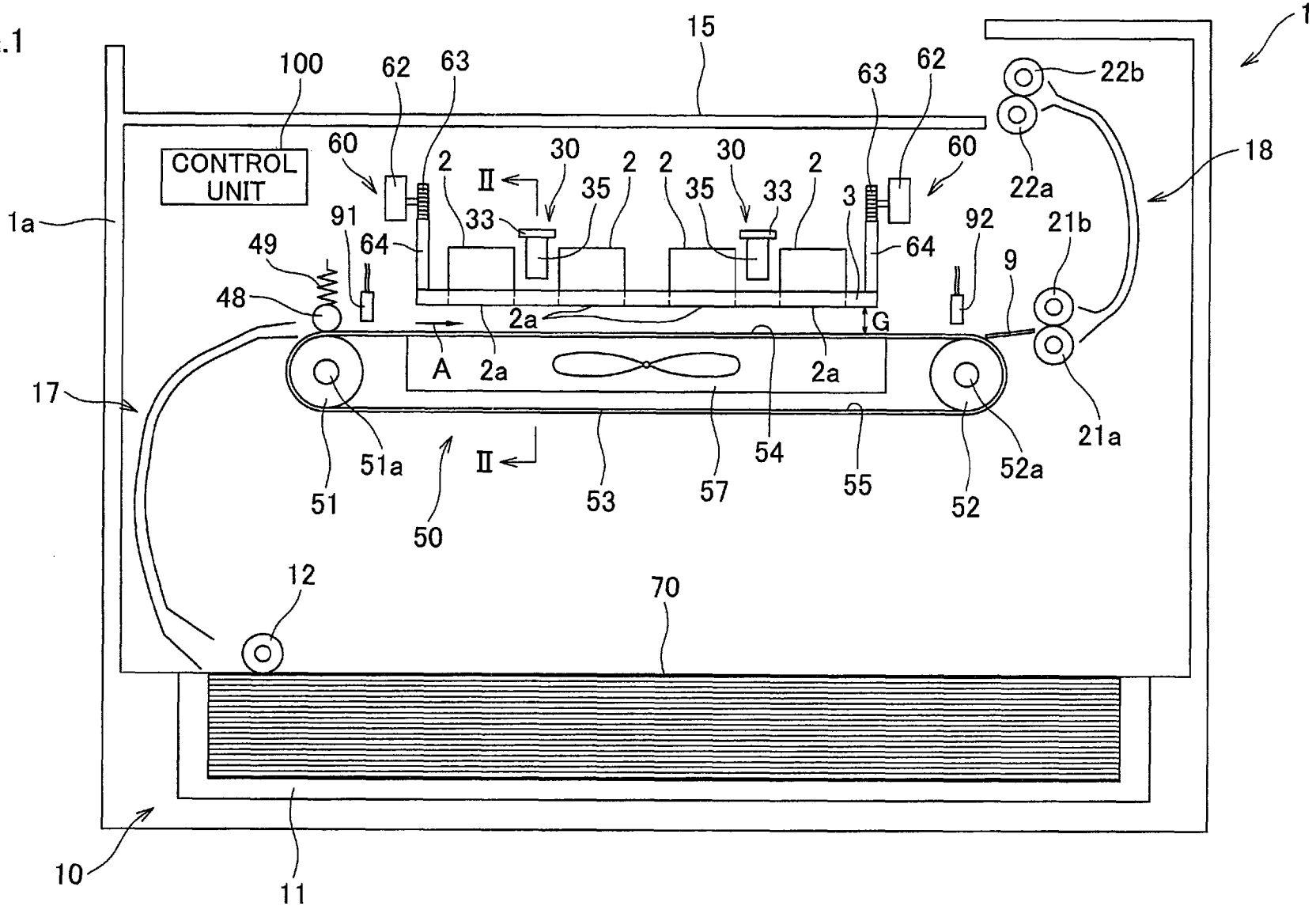
FIG. 1 is a schematic side view illustrating an internal structure of an inkjet printer of a first embodiment of the present invention.

As illustrated in FIG. 1, an inkjet printer 1 of a first embodiment of the present invention is a color inkjet printer having four inkjet heads which respectively eject four different colors of ink: magenta, cyan, yellow, and black. Below the inkjet heads 2 is a conveyor mechanism 50 which conveys a sheet 70 in a conveyance direction A, i.e., direction indicated with an arrow in FIG. 1, while having the sheet 70 face ejection surfaces 2*a*. An ejection surface is a lower surface of an inkjet head 2, and has a plurality of ejection openings formed thereon. The four inkjet heads 2 and the conveyor mechanism 50 are provided inside a housing 1*a*. Inside the housing 1*a* and below the conveyor mechanism 50 is a sheet feed device 10. An upper surface of the housing 1*a* serves as a sheet discharge unit 15 where a plurality of printed sheets 70 are stacked. An operation of each part of the printer 1 is controlled by a control unit 100.

As illustrated in FIG. 1, the sheet feed device 10 includes: a sheet feed cassette 11 capable of storing therein a plurality of stacked sheets 70; a pickup roller 12 which sends out the sheets 70 from the sheet feed cassette 11 sheet by sheet; and a sheet feed motor 13 (see FIG. 4) which rotates the pickup roller 12. The sheet feed cassette 11 is provided to a position where the sheet feed cassette 11 overlaps with the conveyor mechanism 50 in up/down direction in FIG. 1. The pickup roller 12 rotates, contacting the uppermost one of the sheets 70 stored in the sheet feed cassette 11 to send out the sheet 70. Further, inside the housing la is a conveyance guide 17 curved and extending from an upper end of the sheet feed cassette 11 towards an upper surface of the conveyor mechanism 50. The pickup roller 12 rotates clockwise in FIG. 1, causing a sheet 70 contacting the pickup roller 12 to be sent out to the conveyor mechanism 50, through the conveyance guide 17.

Each of the inkjet heads 2 has an elongated rectangular parallelepiped shape whose longitudinal direction extends in a direction perpendicular to the surface of FIG. 1. The four inkjet heads 2 are adjacent to each other in the conveyance direction A, and are fixed to a head plate 3 as a frame. In more detail, the head plate 3 has (not-illustrated) four openings each corresponding to the shape of the inkjet head 2. The four inkjet heads 2 respectively fit into the openings to be fixed in such a manner that a lower surface of the head plate 3 and the ejection surfaces 2*a* are at the same level. Thus, the printer 1 of the present embodiment is a line printer which forms an image with the fixed inkjet heads 2.

Attached to the head plate 3 are two moving mechanisms 30 each of which causes a sheet pusher 35 to move in a direction the inkjet heads 2 and the conveyance mechanism 50 face each other, i.e., up/down direction in FIG. 1. The sheet pusher 35 pushes down the sheet 70 present between the four inkjet heads 2 and the conveyance mechanism 50 towards the conveyor mechanism 50. One of the two moving mechanisms 30 is provided between the most upstream inkjet head 2 and its adjacent inkjet head 2 in the conveyance direction A out of the four inkjet heads 2. The other moving mechanism 30 is provided between the most downstream inkjet head 2 and its adjacent inkjet head 2 in the conveyance direction A. In other words, there is no moving mechanism 30 provided between the second and the third most upstream inkjet heads 2 in the conveyance direction A.

Figure 2:
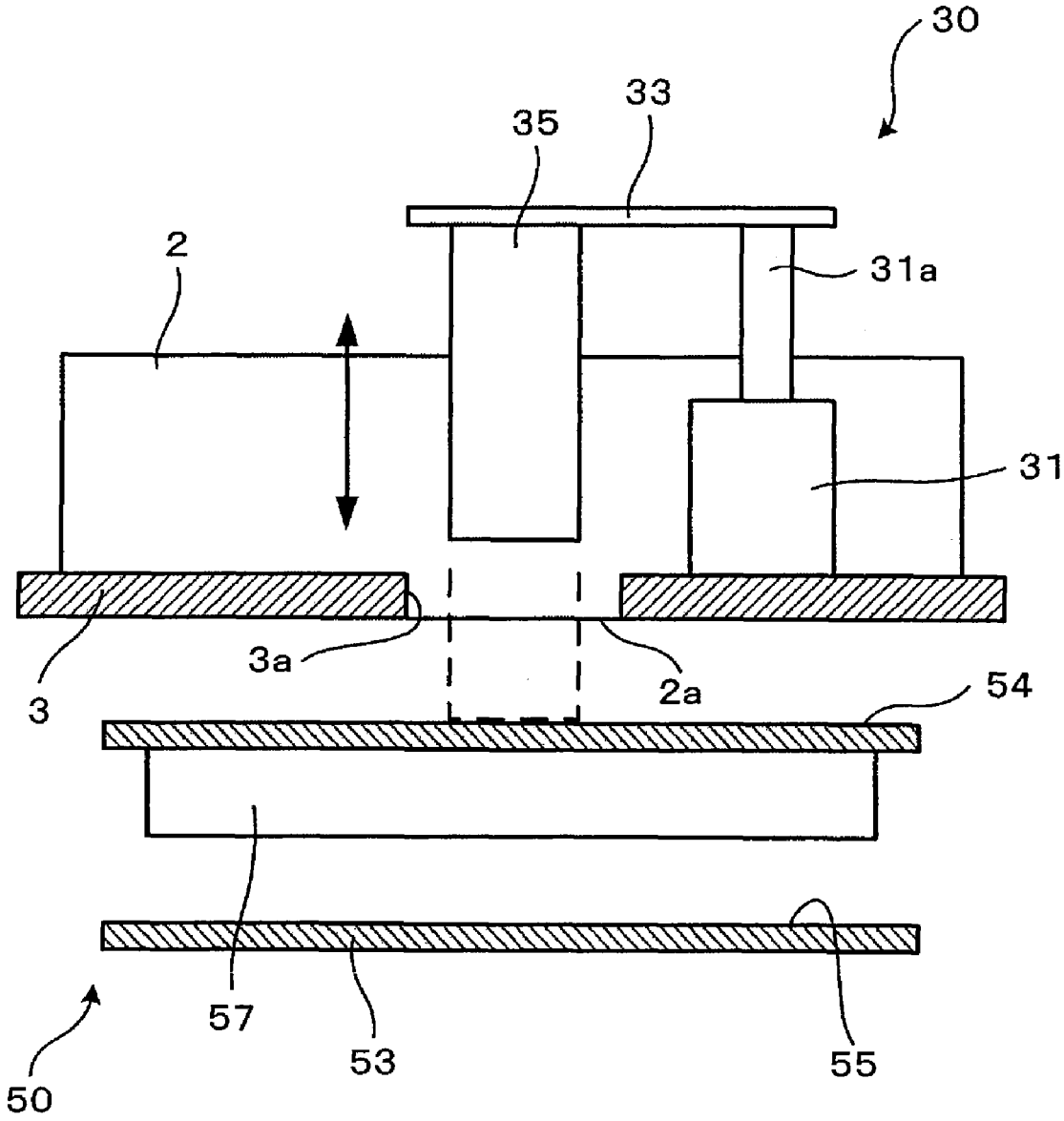
FIG. 2 is a cross sectional view taken along the II-II line of FIG. 1.

The following describes the moving mechanism 30 in more detail with reference to a cross sectional view of between the most upstream inkjet head 2 and its adjacent inkjet head 2, i.e., FIG. 2 illustrating a cross sectional view taken along the II-II line of FIG. 1. Solenoids 31 are attached to an upper surface of the head plate 3 in such a manner that a moving core 31*a* of each solenoid 31 moves in an up/down direction, as illustrated in FIG. 2. An upper end of the moving core 31*a* is fixed to a lower surface of a supporting plate 33. Attached to the lower surface of the supporting plate 33 is the sheet pusher 35. The sheet pusher 35 moves in the up/down direction as the solenoid 31 is driven to cause the moving core 31*a* to move in the up/down direction.

The head plate 3 has openings 3*a* through which the sheet pushers 35 can pass. When the moving core 31*a* is at a projected position, a lower end of each of the sheet pusher 35 is above the opening 3*a* and the ejection surfaces 2*a*. When the moving core 31*a* is at a retracted position, the lower end of the sheet pusher 35 is below the opening 3*a* and the ejection surfaces 2*a*. In other words, each of the sheet pushers 35 moves between a first position illustrated with a solid line in FIG. 2 and a second position illustrated with a broken line in FIG. 2, the first position being a position above the ejection surfaces 2*a*, and the second position being a position where the sheet pusher 35 contacts a facing region facing the four ejection surfaces 2*a* on a conveyor surface 54. The conveyor surface 54 is an outer circumferential surface of a later-described conveyor belt 53. The first position may be at the same level as the ejection surfaces 2*a* as a modification.

Now back to FIG. 1, the head plate 3 is elevatably supported by two head elevation mechanisms 60. The two head elevation mechanisms 60 are respectively provided to both sides of the head plate 3 in the conveyance direction A. Each of the head elevation mechanisms 60 includes an elevation motor 62 as a drive source of the up/down movement, a pinion gear 63 fixed to a shaft of the elevation motor 62, and a rack gear 64 which stands on the head plate 3 and meshes with the pinion gear 63.

When the two elevation motors 62 synchronizingly run to rotate the pinion gears 63 in one or the other direction, the rack gears 64 move up or down. As the rack gears 64 move up/down, the head plate 3, the four inkjet heads 2, and the moving mechanisms 30 move up/down. The two head elevation mechanisms 60 is driven to move the four inkjet heads 2 between a printing position and a withdrawal position. The printing position is where printing is performed to a sheet 70 being conveyed on the conveyor belt 53. The withdrawal position is above the printing position. Thus, it is possible to change a gap G between the facing region on the conveyor belt 53 and the four inkjet heads 2. That is, each of the two head elevation mechanisms 60 serves as a gap changing mechanism in the present embodiment.

When the head elevation mechanisms 60 position the inkjet heads 2 at the printing position, the ejection surfaces 2*a* of the inkjet heads 2 and the conveyor surface 54 of the conveyor belt 53 parallel one another. A sheet 70 is conveyed between the ejection surfaces 2*a* and the conveyor surface 54 in the conveyance direction A. Ink of the respective colors is ejected from the ejection openings towards an upper surface of the sheet 70 serving as a printing surface, when the sheet 70 conveyed on the conveyor belt 53 sequentially passes immediately below the four inkjet heads 2. A desired color image is thus formed.

Figure 3:
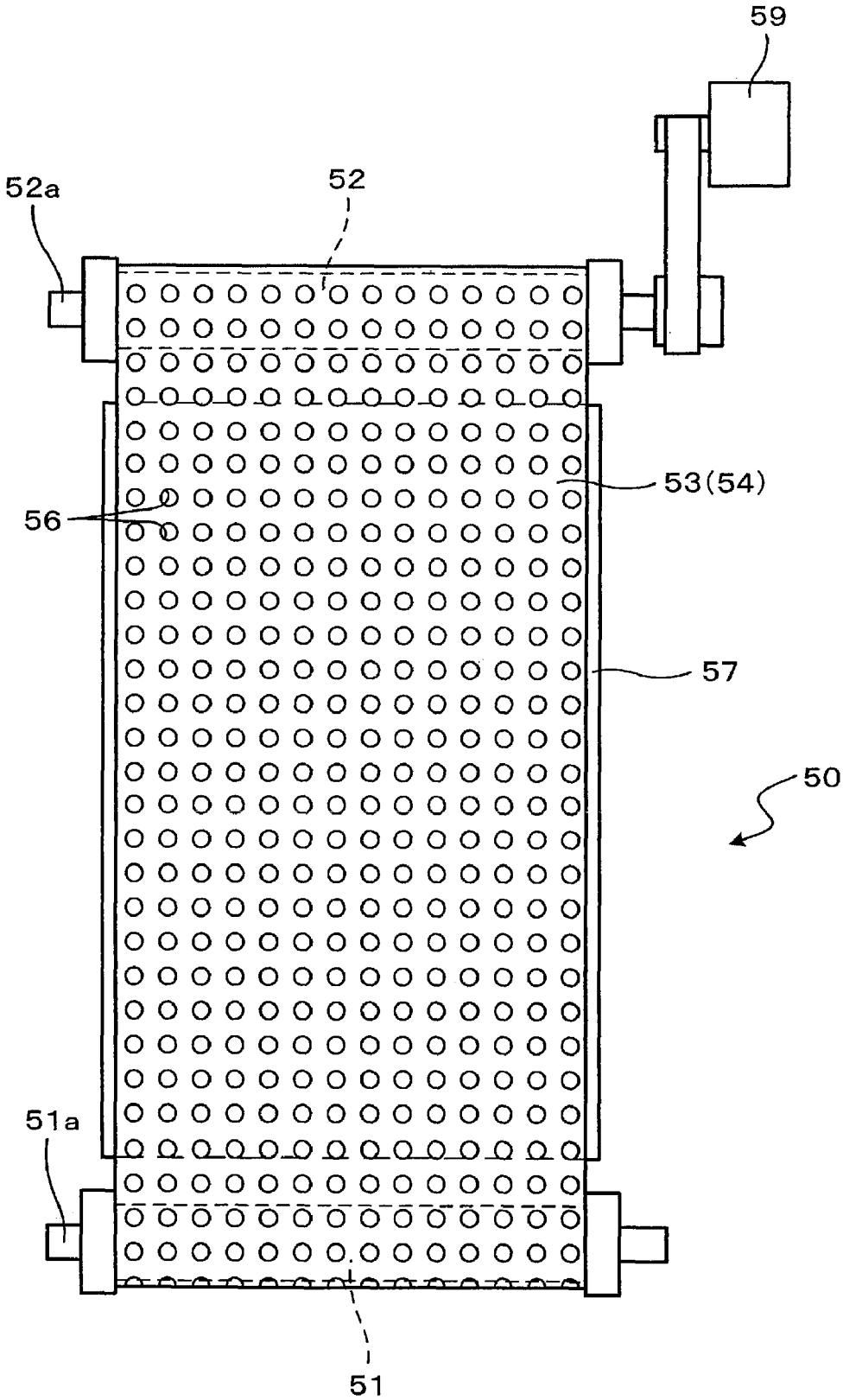
FIG. 3 is a plan view of the conveyor mechanism shown in FIG. 1.

The conveyor mechanism 50 includes two belt rollers 51 and 52 respectively formed around rotating shafts 51*a* and 52*a* parallel to each other, and an endless conveyor belt 53 looped around the belt rollers 51 and 52. A region of the conveyor surface 54 facing the four ejection surfaces 2*a* is referred to as a facing region in the present embodiment. The conveyor surface 54 is the outer circumferential surface of the conveyor belt 53. Here, the conveyor belt 53 has a plurality of holes 56 penetrating the conveyor belt 53 in the thickness direction from the conveyor surface 54 to an inner circumferential surface, i.e., a reverse surface 55, as illustrated in FIG. 3 illustrating a plan view of the conveyor mechanism 50. These holes 56 are uniformly scattered on the entire conveyor belt 53. Further, inside an area surrounded by the loop conveyor belt 53 is a fan 57 which sucks air around the facing region into inside the conveyor belt 53 through the holes 56. Suction force generated by rotation of the fan 57 allows the sheet 70 placed on the conveyor surface 54 to adhere to the facing region of the conveyor surface 54. The holes 56 penetrating the conveyor belt 53, and the fan 57 serve as a suction mechanism in the present embodiment.

Above the belt roller 51 is a nip roller 48 provided so as to face the belt roller 51 via the conveyor belt 53. A rotating shaft of the nip roller 48 is parallel to the rotating shaft 51*a* of the belt roller 51. The nip roller 48 is biased towards the conveyor surface 54 by a coil spring 49 serving as an elastic member. The sheet 70 being conveyed from the sheet feed device 10 to the conveyor mechanism 50 is sandwiched between the nip roller 48 and the conveyor belt 53 and pressed onto the conveyor surface 54. The nip roller 48, which is a driven roller, rotates as the conveyor belt 53 runs. Meanwhile, the belt roller 52 provided more downstream than the belt roller 51 in the conveyance direction A is a driving roller rotated clockwise in FIG. 1 by a conveying motor 59 (see FIG. 4).

Further, a sheet sensor 91 is provided between the most upstream inkjet head 2 in the conveyance direction A and the nip roller 48. A sheet sensor 92 is provided to a position more downstream than the most downstream inkjet head 2 in the conveyance direction A, and facing the belt roller 52. Each of the sheet sensors 91 and 92 is a reflective photosensor which outputs signals of different levels according to whether there is a sheet 70 present below the sheet sensor 91 or 92. Thus, based on a signal outputted from the sheet sensor 91 or 92, it is possible to recognize whether there is a sheet 70 present below each of the sensors 91 and 92, and timing when the leading end of the sheet 70 passes below the sheet sensor 91 or 92.

Provided immediately downstream of the conveyor mechanism 50 in the conveyance direction A is a separation plate 9. An upstream end of the separation plate 9 gets in between the sheet 70 and the conveyor belt 53 to separate the sheet 70 from the conveyor surface 54.

Along the conveyance path between the belt conveyor mechanism 50 and the sheet discharge unit 15 are: four discharge rollers 21*a*, 21*b*, 22*a*, and 22*b*; and a conveyance guide 18 provided between the discharge rollers 21*a* and 21*b*, and the discharge rollers 22*a* and 22*b*. The discharge rollers 21*b* and 22*b* are driving rollers driven by discharge motors 23 and 24 (see FIG. 4), respectively. The discharge rollers 21*a* and 22*a* are driven rollers. Thus, the discharge rollers 21*b* and 22*b* rotate to discharge a sheet 70 from the conveyor mechanism 50, and sandwich the sheet 70 to send the sheet 70 upward through the conveyance guide 18. The sheet 70 is then discharged to the sheet discharge unit 15 while being sandwiched by the discharge rollers 22*a* and 22*b*.

A position facing the conveyor mechanism 50 on a side surface of the housing 1*a* in the conveyance direction A is a not-illustrated opening. There is an openable door fitted into the opening. Thus, when a sheet 70 jams between the inkjet heads 2 and the conveyor mechanism 50, a user is able to open the door and remove the sheet 70.

The following describes the control unit 100. The control unit 100 stores hardware such as a Central Processing Unit (CPU), a Read Only Memory (ROM), and a Random Access Memory (RAM). The ROM stores various kinds of software including programs for controlling an operation of the printer 1. Later-described units 101 to 107 (see FIG. 4) are combinations of these kinds of hardware and software.

Figure 4:
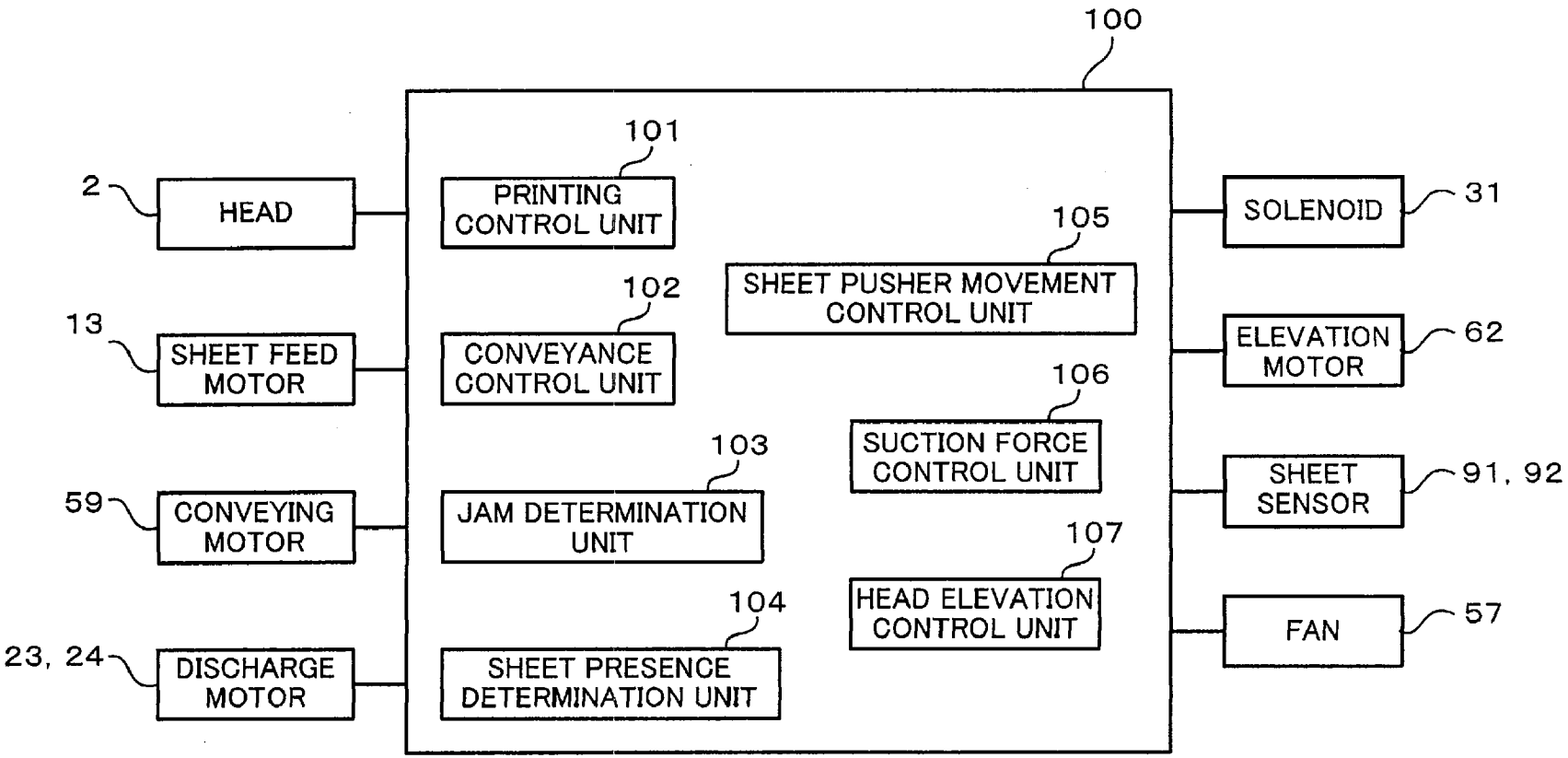
FIG. 4 is a block diagram illustrating a schematic configuration of the control unit shown in FIG. 1.

As illustrated in FIG. 4 showing a block diagram of a schematic configuration of the control unit 100, the control unit 100 includes a print control unit 101, a conveyance control unit 102, a jam determination unit 103, a sheet presence determination unit 104, a sheet pusher movement control unit 105, a suction force control unit 106, and a head elevation control unit 107. The control unit 100 is connected to the four inkjet heads 2, the sheet feed motor 13, the conveying motor 59, the discharge motors 23 and 24, the solenoids 31 of the two moving mechanisms 30, the elevation motors 62 of the two head elevation mechanisms 60, the sheet sensors 91 and 92, and the fan 57. Note that FIG. 4 shows only one inkjet head 2 instead of four.

The print control unit 101 controls the four inkjet heads 2 to start ejecting ink after a predetermined period of time after the leading end of a sheet 70 having been sent out to the facing region of the conveyor mechanism 50 reaches below the sheet sensor 91. For instance, the print control unit 101 controls the four inkjet heads 2 to start ejecting ink after a predetermined period of time after the level of an output signal from the sheet sensor 91 changes from a sheet undetect level, e.g., low level to a sheet detect level, e.g., high level. A desired image is thus formed on the sheet 70. Here, the predetermined period of time is determined according to a distance between the sheet sensor 91 and each of the inkjet heads 2, sheet 70 conveying speed of the conveyor belt 53, and a formation position of an image on the sheet 70.

The conveyance control unit 102 controls the sheet feed motor 13, the conveying motor 59, and the discharge motors 23 and 24 so as to convey a sheet 70 in the sheet feed cassette 11 to the sheet discharge unit 15. The conveyance control unit 102 controls the sheet feed motor 13, the conveying motor 59, and the discharge motors 23 and 24 so as to stop conveying the sheet 70 when the jam determination unit 103 determines that the sheet 70 is jammed.

The jam determination unit 103 determines whether or not a sheet is jammed between the inkjet heads 2 and the conveyor mechanism 50 based on output signals from the two sheet sensors 91 and 92. Specifically, the jam determination unit 103 determines that a sheet is jammed when the level of an output signal from the sheet sensor 92 does not change from the sheet undetect level to the sheet detect level within a predetermined period of time after the level of the output signal from the sheet sensor 91 has changed from the sheet undetect level to the sheet detect level. In other words, in the present embodiment, the jam determination unit 103 and the two sheet sensors 91 and 92 serve as a jam detector which detects a sheet jam.

The sheet presence determination unit 104 determines presence of a sheet 70 between the inkjet heads 2 and the conveyor surface 54 of the conveyor mechanism 50, based on output signals from the sheet sensors 91 and 92. Specifically, when both of the levels of output signals from the sheet sensors 91 and 92 are at the sheet undetect level, the sheet presence determination unit 104 determines that there is no sheet 70 present between the inkjet heads 2 and the conveyor surface 54. In other cases, i.e., when at least one of the output signals from the sheet sensors 91 and 92 is at the sheet detect level, the sheet presence determination unit 104 determines that there is a sheet 70 present between the inkjet heads 2 and the conveyor surface 54. In other words in the present embodiment, the sheet presence determination unit 104 and the two sheet sensors 91 and 92 serve as a medium detector which detects presence/absence of a sheet 70 between the four inkjet heads 2 and the conveyor mechanism 50.

The sheet pusher movement control unit 105 controls the solenoids 31 of the two moving mechanisms 30 to cause the two sheet pushers 35 to move up/down. Specifically, the sheet pusher movement control unit 105 controls the two solenoids 31 so that the sheet pushers 35 are at the first position above the ejection surfaces 2*a* when the four inkjet heads 2 are forming an image on a sheet 70. When the jam determination unit 130 determines that a sheet is jammed, the sheet pusher movement control unit 105 controls the two solenoids 31 to move the sheet pushers 35 from the first position to the second position where the sheet pushers 35 contact the conveyor surface 54. After a sheet jam is detected, and while the sheet presence determination unit 104 is determining that there is a sheet present between the four inkjet heads 2 and the conveyor surface 54, the sheet pusher movement control unit 105 controls the two solenoids 31 to cause the lower ends of the sheet pushers 35 to be positioned between the ejection surfaces 2*a* and the facing region. Meanwhile, after a sheet jam is detected and the sheet presence determination unit 104 determines that there is no sheet present between the four inkjet heads 2 and the conveyor surface 54, the sheet pusher movement control unit 105 controls the two solenoids 31 so as to move the lower ends of the sheet pushers 35 to the first position. The lower ends of the sheet pushers 35 are the parts of the sheet pushers 35 which contact the facing region. In other words, the sheet pusher movement control unit 105 serves as first and second movement controllers in the present embodiment.

The suction force control unit 106 controls the magnitude of a suction force by which a sheet 70 placed on the conveyor surface 54 is adhered to the conveyor surface 54, by controlling rotation of the fan 57. Specifically, the suction force control unit 106 controls the fan 57 so that the magnitude of the suction force is higher when the two sheet pushers 35 are at the second position than at the first position.

The head elevation control unit 107 controls the elevation motors 62 of the two head elevation mechanisms 60. Specifically, the head elevation control unit 107 controls the two elevation motors 62 so that the four inkjet heads 2 at the printing position go up to the withdrawal position after the two sheet pushers 35 move from the first position to the second position under control of the sheet pusher movement control unit 105. This expands the gap G between the four inkjet heads 2 and the facing region of the conveyor mechanism 50. Further, the head elevation control unit 107 controls the two elevation motors 62 so that the four inkjet heads 2 go down to the printing position after the two sheet pushers 35 move from the second position to the first position under control of the sheet pusher movement control unit 105. In other words, the head elevation control unit 107 serves as a gap controller in the present embodiment.

Figure 5:
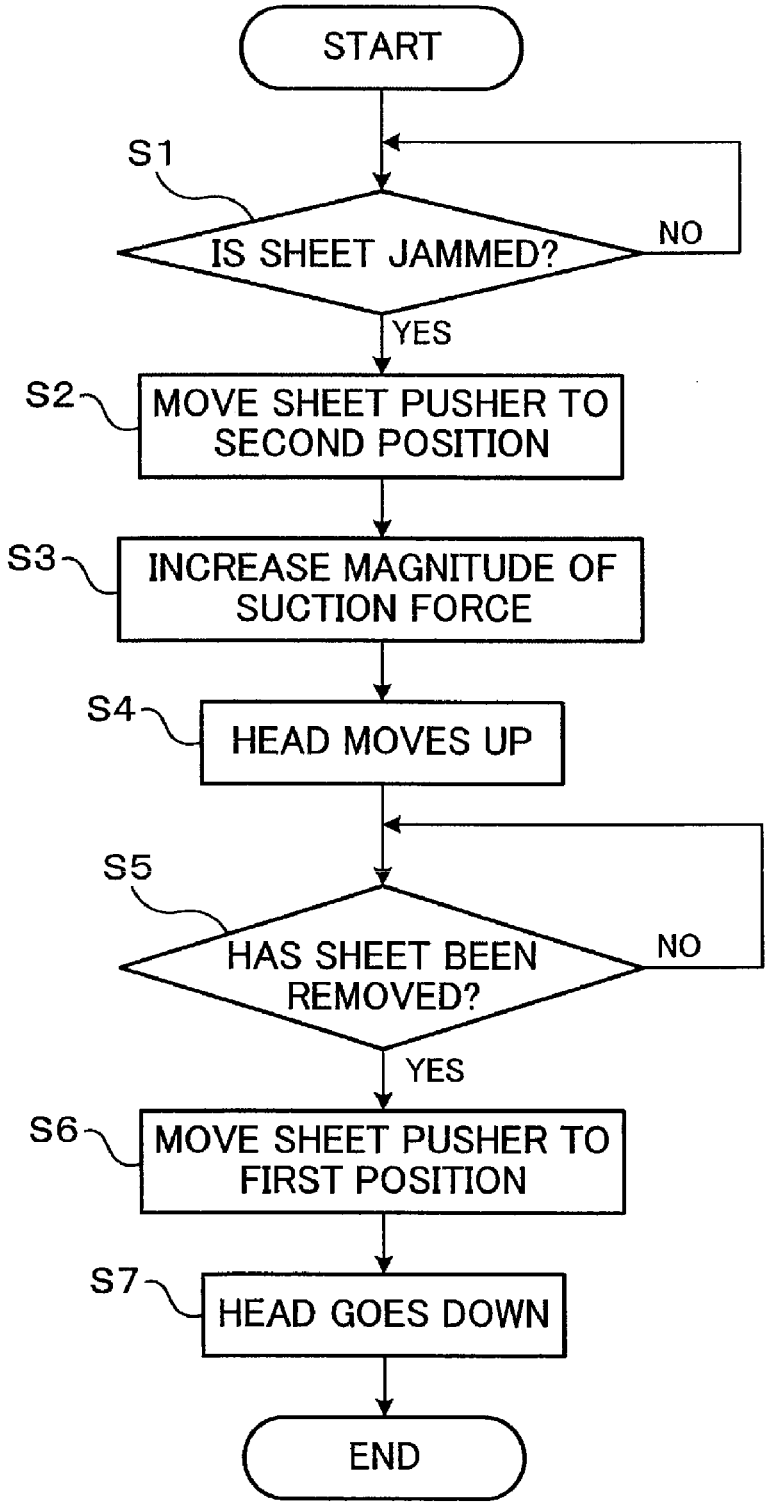
FIG. 5 is a flow chart illustrating procedures carried out in the control unit shown in FIG. 4.

The following describes an operation carried out when a sheet jams in the printer 1 of the present embodiment, with reference to the flow chart of FIG. 5 illustrating procedures carried out in the control unit 100. Note that FIGS. 6A to 6D illustrate operations of the inkjet heads 2 and the sheet pushers 35 when a sheet is jammed.

Figure 6A:
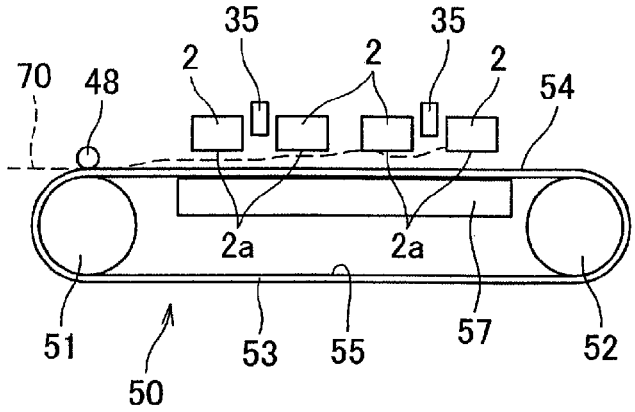
FIGS. 6A to 6D are side views illustrating operations of the inkjet heads and the sheet pushers shown in FIG. 1 when a sheet is jammed.

During printing, the jam determination unit 103 constantly monitors whether or not a sheet is jammed between the inkjet heads 2 and the conveyor mechanism 50 (step S1). In other words, the jam determination unit 103 repeats determining whether or not a sheet is jammed until the jam determination unit 103 determines a sheet jam. When the jam determination unit 103 determines that a sheet is jammed (S1: YES), the print control unit 101 stops ink ejection from one or more of the inkjet heads 2, and the conveyance control unit 102 stops conveying the sheet 70. FIGS. 6A illustrate a state of the printer 1 when a sheet is jammed. When a sheet 70 is jammed, the sheet 70 may be attached to the ejection surface 2*a* of the at least one out of the four inkjet heads 2, as illustrated. At this point, the sheet pushers 35 are at the first position.

Figure 6B:
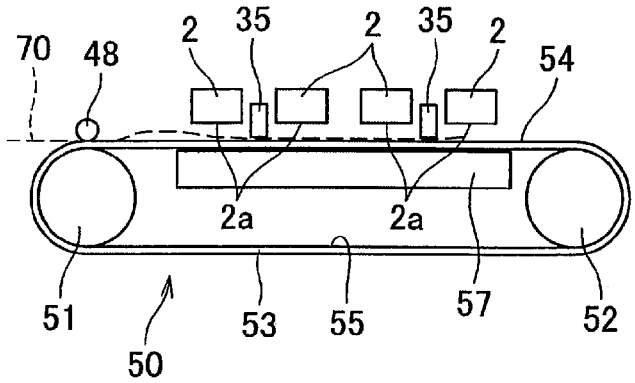

In step S2, the sheet pusher movement control unit 105 moves the two sheet pushers 35 at the first position to the second position. Thus, the sheet 70 attached to the ejection surface 2*a* of the at least one out of the four inkjet heads 2 is pushed on to the conveyor surface 54 by one or both of the sheet pushers 35, as illustrated in FIG. 6B.

Figure 6C:
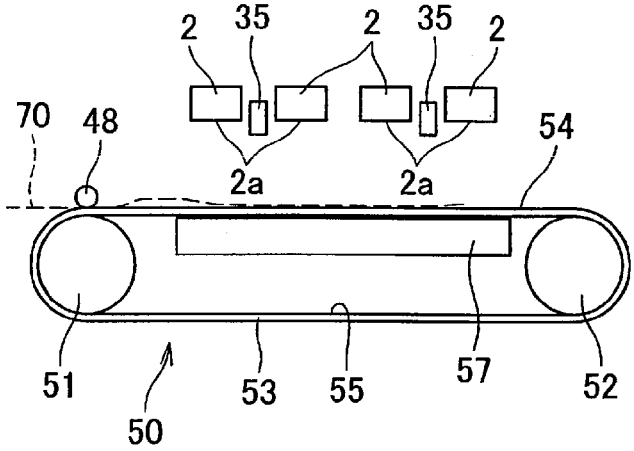

In step S3, based on control of the suction force control unit 106, the magnitude of the suction force increases compared to when the sheet pushers 35 are at the first position. This allows the conveyor surface 54 to surely support the sheet 70 pressed on to the conveyor surface 54, detaching the sheet 70 from the sheet pushers 35. Next, in step S4, the head elevation control unit 107 brings up the four inkjet heads 2 at the printing position to the withdrawal position along with the sheet pushers 35. This expands the gap G between the four inkjet heads 2 and the conveyor mechanism 50, as illustrated in FIG. 6C. Thus, a user is able to easily remove the jammed sheet 70.

At this point, as illustrated in FIG. 6C, the lower ends of the two sheet pushers 35 is between the ejection surfaces 2*a* and the facing region, as illustrated in FIG. 6C. Thus, even if a sheet 70 separates from the conveyor surface 54 and is lifted, one or both of the sheet pushers 35 prevent the sheet 70 from being attached to the ejection surface 2*a* again.

Figure 6D:
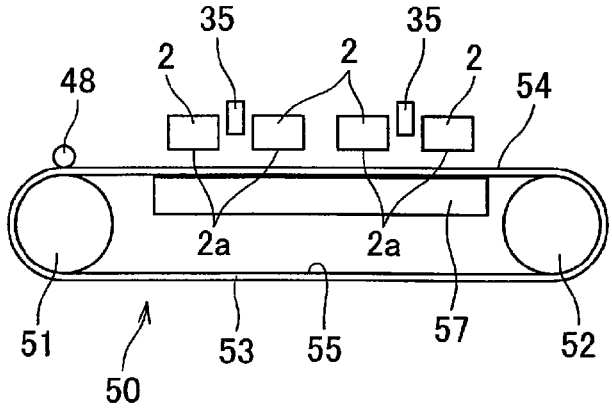

Afterwards in step S5, the sheet presence determination unit 104 repeatedly determines whether a sheet 70 is present between the inkjet heads 2 and the conveyor surface 54, until the sheet 70 is removed. When the sheet presence determination unit 104 determines that there is no sheet 70 present since a user has already removed the sheet 70 (S5: YES), the process moves to step S6. Instep S6, the sheet pusher movement control unit 105 moves the two sheet pushers 35 to the first position. Further in step S7, the head elevation control unit 107 brings down the four inkjet heads 2 at the withdrawal position to the printing position along with the two sheet pushers 35. Thus, as illustrated in FIG. 6D, the sheet 70 is removed from between the inkjet heads 2 and the conveyor surface 54, and thus the printer 1 returns to a printable state.

As described above, according to the printer 1 of the present embodiment, when a sheet 70 is attached to one or more of the ejection surfaces 2*a*, one or both of the sheet pushers 35 detach the sheet 70 from the one or more of the ejection surfaces 2*a*, and thus the sheet 70 is pushed down to the facing region of the conveyor belt 53. Thus, it is possible to prevent a sheet 70 from being left attached to the one or more of the ejection surfaces 2*a*. Thus, the following never occurs: A sheet 70 is left attached to the ejection surfaces 2*a* for a long period of time, making the sheet 70 undetachable from the ejection surfaces 2*a*.

Further, in the printer 1 of the present embodiment, the magnitude of the suction force is higher when the sheet pushers 35 are at the second position than when the sheet pushers 35 are at the first position. Thus, a sheet 70 pushed on to the conveyor surface 54 by one or both of the sheet pushers 35 surely adheres to the conveyor surface 54, allowing the sheet 70 to be easily detached from the one or both of the sheet pushers 35.

Further in the printer 1 of the present embodiment, the sheet sensors 91 and 92 and the jam determination unit 103 detects a sheet jam, and when a sheet jam is detected, the two sheet pushers 35 are moved from the first position to the second position. Thus, when a sheet 70 is jammed, the sheet 70 is surely detached from the ejection surfaces 2*a*.

In addition, the printer 1 of the present embodiment brings up the four inkjet heads 2 at the printing position to the withdrawal position after the two sheet pushers 35 move from the first position to the second position, thus expanding the gap G between the inkjet heads 2 and the facing region. Thus, a user is able to easily remove the jammed sheet 70.

Further, the printer 1 of the present embodiment does not have a moving mechanism 30 provided between the second and the third most upstream inkjet heads 2 in the conveyance direction A. Thus, there can be fewer moving mechanisms 30 compared to a case where a moving mechanism 30 is provided between every pair of adjacent inkjet heads 2. Particularly in the present embodiment, the moving mechanisms 30 are provided only between the most upstream inkjet head 2 and its adjacent inkjet head 2, and between the most downstream inkjet head 2 and its adjacent inkjet head 2 among the four inkjet heads 2. Thus, there are fewer moving mechanisms 30 even in a case where there are more inkjet heads 2 provided.

Further in the printer 1 of the present embodiment, after the two sheet pushers 35 are moved from the first position to the second position, the lower surfaces of the two sheet pushers 35 are positioned between the ejection surfaces 2*a* and the facing region of the conveyor belt 53, until the sheet presence determination unit 104 determines that there is no sheet 70 present between the four inkjet heads 2 and the conveyor surface 54 of the conveyor mechanism 50. Thus, it is possible to prevent the sheet 70 once detached from the ejection surfaces 2*a* from reattaching to the ejection faces 2*a*.

<First Modification>

Figure 7:
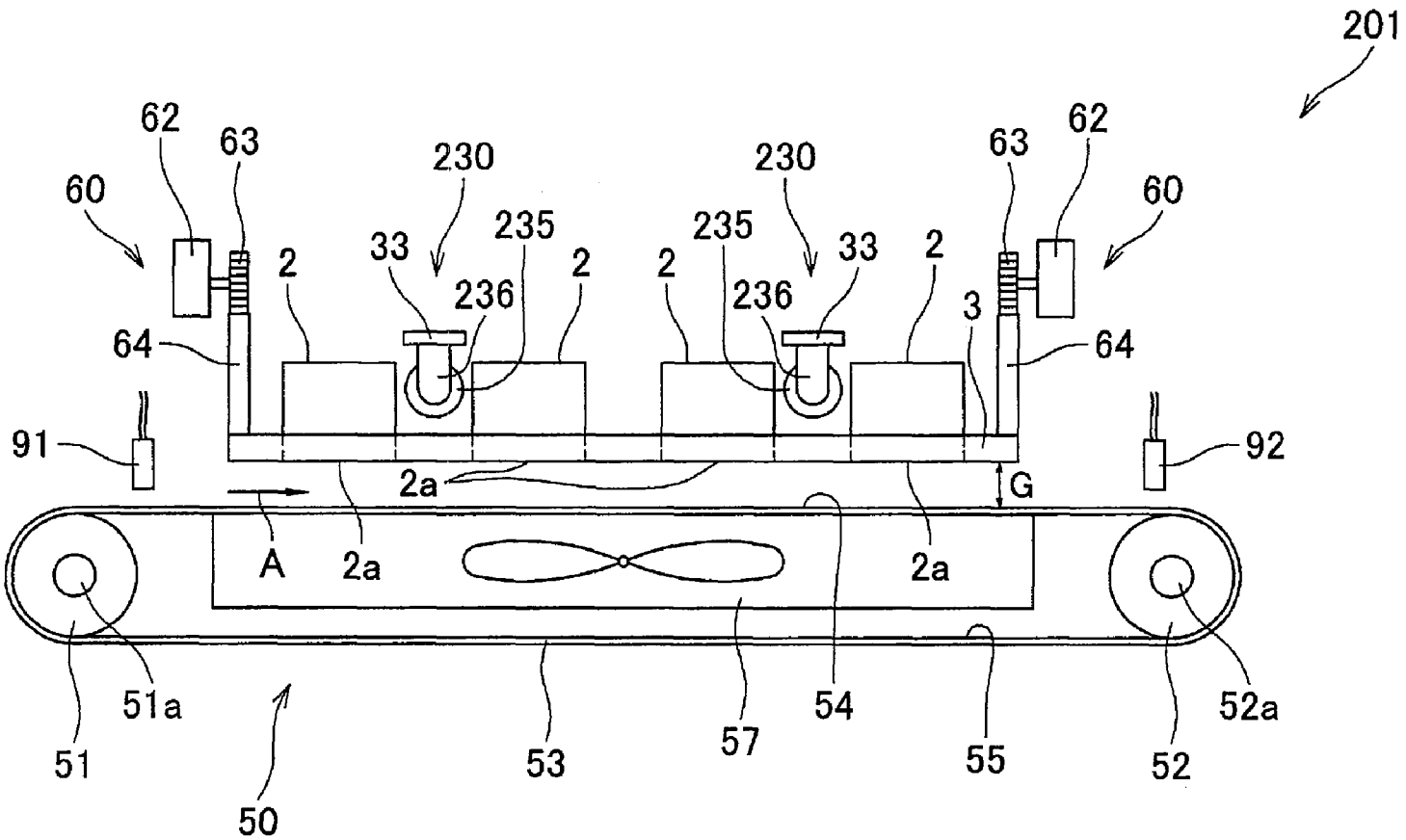
FIG. 7 illustrates a schematic configuration of the printer of a first modification.

The following describes a first modification of the above embodiment with reference to FIG. 7. FIG. 7 is a schematic configuration of a printer of the present modification. Only the structure of a moving mechanism including a sheet pusher in the present modification differs from that of the above embodiment. Other structures are substantially the same as those of the above embodiment. The members having substantially the same structures as those of the above embodiment will be denoted by the same reference numerals, without specific descriptions thereof.

As illustrated in FIG. 7, a printer 201 of the present modification includes two moving mechanisms 230. A sheet pusher 235 included in each of the moving mechanisms 230 is a roller rotatable around a shaft parallel to the four ejection surfaces 2*a* and perpendicular to the conveyance direction A. Each of the sheet pushers 235 is rotatably supported by a holder 236. The holder 236 supporting the sheet pusher 235 is attached to the supporting plate 33 to which the moving core 31*a* of the solenoid 31 is fixed. When the sheet pushers 235, which are rollers, are at the second position and thus contact the conveyor surface 54, the sheet pushers 235 rotate as the conveyor belt 53 runs. The two sheet pushers 235 move to the second position to sandwich a jammed sheet 70 between the two sheet pushers 235 and the conveyor belt 53. The sheet 70 thus receives conveying force in the conveyance direction A as the conveyor belt 53 runs.

In other words, according to the printer 201 of the present modification, after the sheet pushers 235 have moved from the first position to the second position, the conveyor belt 53 is driven with the sheet pushers 235 pushing down a sheet 70 to the conveyor surface 54. Thus, the jammed sheet 70 is discharged from between the four inkjet heads 2 and the conveyor mechanism 50 without having the head elevation mechanisms 60 expand the gap G between the four inkjet heads 2 and the conveyor mechanism 50. This enables a user to more easily handle a sheet jam.

<Second Modification>

Figure 8A:
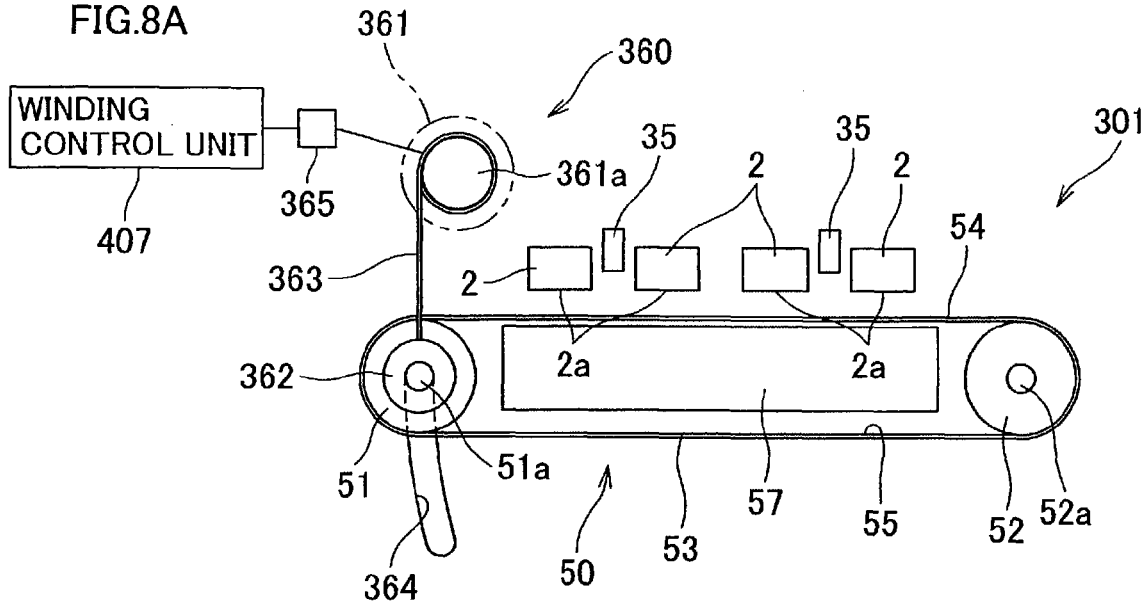
FIGS. 8A and 8B illustrate a schematic configuration of a printer according to a second modification.
Figure 8B:
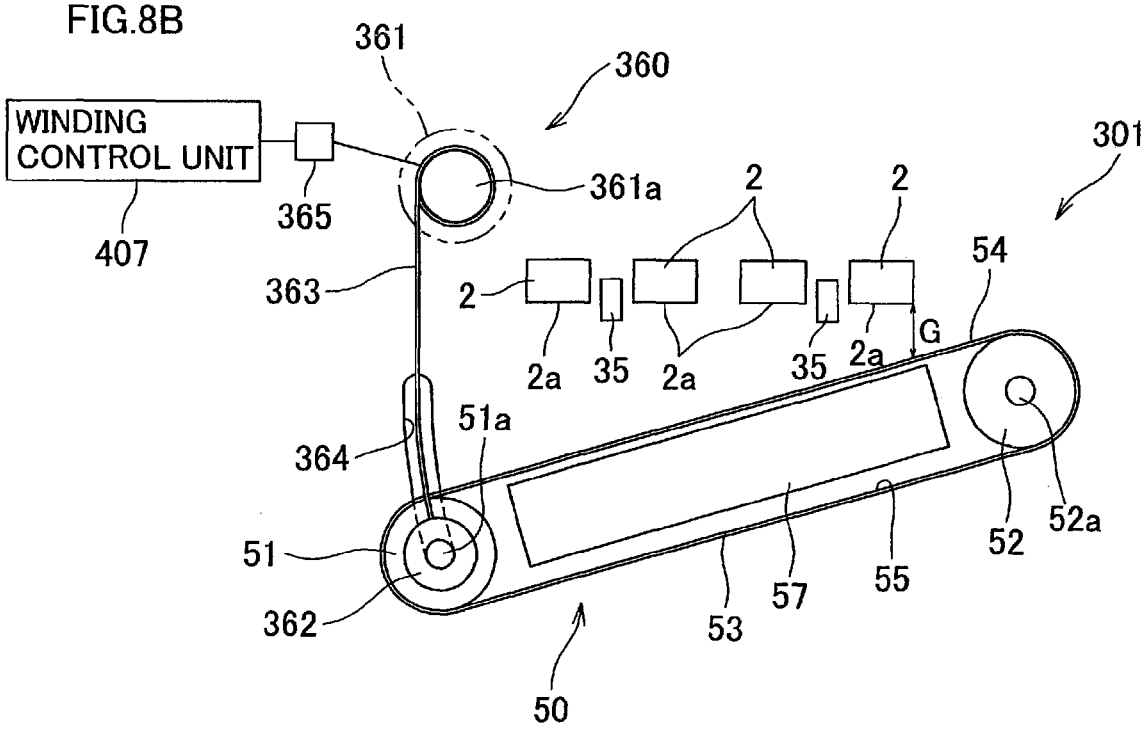

The following describes a second modification of the above embodiment with reference to FIGS. 8A and 8B. FIGS. 8A and 8B illustrate a schematic configuration of a printer of the present modification. The differences between the structure of the present modification and the structure of the printer 1 of the above embodiment are as follows: In the above embodiment, the head elevation mechanisms 60 bring up the four inkjet heads 2 to change the gap G between the four inkjet heads 2 and the facing region. On the other hand in the present modification, the conveyor mechanism 50 is moved to change the gap G between the four inkjet heads 2 and the facing region. Structures of other members are substantially the same as those in the above embodiment. The members having substantially the same structures as those of the above embodiment will be denoted by the same reference numerals, without specific descriptions thereof.

A printer 301 of the present modification includes a roller moving mechanism 360. The roller moving mechanism 360 moves the belt roller 51 which is a driven roller. Specifically, the roller moving mechanism 360 is capable of swinging the belt roller 51 about the rotating shaft 52*a* of the belt roller 52 which is a driven roller. As a result, the roller moving mechanism 360 is capable of moving the belt roller 51 between a conveyance position as illustrated in FIG. 8A and a withdrawal position as illustrated in FIG. 8B. The conveyance position is where an upper end of the belt roller 51 is at the same level as an upper end of the belt roller 52. The withdrawal position is below the conveyance position.

The roller moving mechanism 360 includes a winding roller 361, a ring 362, a wire 363 as a connecting member, and two guide holes 364 respectively formed on not-illustrated two perpendicular fixed plates facing each other. The ring 362 is provided near the both ends of the rotating shaft 51*a* of the belt roller 51, and rotatably supports the rotating shaft 51*a*. Two guide holes 364 are respectively provided to positions respectively facing the both ends of the rotating shaft 51*a* in the housing 1*a*. The both ends of the rotating shaft 51*a* are respectively inserted into the guide holes 364. Each of the guide holes 364 extends obliquely downward towards the right, forming an arc around the rotating shaft 52*a* of the belt roller 52. An upper end of the arc is at a position of the rotation shaft 51*a* when the belt roller 51 is at the conveying position.

One end of the wire 363 is fixed to an upper end of the ring 362. The other end of the wire 363 is fixed to a rotating shaft 361*a* of the winding roller 361. The winding roller 361 is rotated by a winding motor 365 capable of rotating in both directions. The winding roller 361 rotates clockwise in FIG. 8A, winding the wire 363 around the rotating shaft 361*a*. Reversely, the winding roller 361 rotates counterclockwise in FIG. 8A, unwinding the wire 363 from the rotating shaft 361*a*. Note that driving of the winding motor 365 is controlled by a winding control unit 407.

In the printer 301 of the present modification, when a sheet jams between the inkjet heads 2 and the conveyor mechanism 50, the two sheet pushers 35 are moved from the first position to the second position, and the magnitude of the suction force by which the sheet is adhered to the conveyor surface 54 is increased. Afterwards, the winding control unit 407 rotates the winding roller 361 counterclockwise to unwind the wire 363 winded around the winding roller 361. This allows the rotating shaft 51*a* to move obliquely downward towards the right along the guide hole 364 along with the ring 362, and to stop at a lower end of the guide hole 364. This expands the gap G between the four inkjet heads 2 and the facing region.

After a jammed sheet 70 has been removed, and the two sheet pushers 35 have returned to the first position, the winding control unit 407 rotates the winding roller 361 clockwise to wind up the wire 363 around the winding roller 361. Thus, the rotating shaft 51*a* moves obliquely upward towards the left along the guide hole 364 until the belt roller 51 returns to the conveying position.

According to the present modification, the printer 301 allows the sheet 70 attached to one or more of the ejection surfaces 2*a* when jammed to be detached from the one or more ejection surfaces, as described above. Further, the gap G between the inkjet heads 2 and the conveyor mechanism 50 is expanded thereafter. This allows a user to easily remove the sheet 70.

<Another Modification>

The first position of the sheet pushers 35 is above the ejection surfaces 2*a* in the above embodiment; however, the first position may be at the same level as the ejection surfaces 2*a*. In other words, the first position may be such a position where the distance between the facing region and the sheet pushers 35 is equal to or farther than the distance between the facing region and the ejection surfaces 2*a*, i.e., (distance between the first position and the facing region)≧(distance between the ejection surfaces 2*a* and the facing region). Further, the above embodiment is described taking as an example a case where four inkjet heads 2 are provided; however, the number of inkjet heads 2 may be one, two, three, or five or more. Further, a conveyor mechanism is not limited to one including the conveyor belt 53. The conveyor mechanism may be any kind, e.g., one having a drum whose side surface holds a sheet thereon, or one having a flat platen on which a sheet is placed, as long as the conveyor mechanism has a facing region facing the ejection surfaces. Furthermore, the above embodiment describes a printer including a suction force control unit 106 which controls, with the fan 57, the magnitude of the suction force by which a sheet 70 placed on the conveyor surface 54 is adhered to the conveyor surface 54. However, in this invention, no suction force control unit is required. In this case, the adhesion of a sheet 70 to the conveyor surface 54 may be implemented due to an adhesive layer formed on a surface of the conveyor belt 53 by silicone treatment or the like. Thus, the magnitude of the suction force may be constant. Further, the conveyor surface 54 does not necessarily have adhesion.

Further, the above embodiment describes a case where the gap G between the inkjet heads 2 and the facing region is expanded by having the elevation mechanisms 60 bring up the inkjet heads 2. Furthermore, the second modification describes a case where the gap G is expanded by moving the belt roller 51 with the roller moving mechanism 360. The gap G, however, is not necessarily changeable.

Further, the above embodiment describes a case where both the jam determination unit 103 and the sheet presence determination unit 104 perform determination based on output signals from the sheet sensors 91 and 92. However, there may be a sensor for the jam determination unit 103 to perform determination, and a sensor for the sheet presence determination unit 104 to perform determination provided separately.

In addition, the present embodiment describes a case where the lower ends of the two sheet pushers 35 are positioned between the ejection surfaces 2*a* and the facing region when a sheet is jammed until the sheet is removed from between the four inkjet heads 2 and the conveyor surface 54. However, the two sheet pushers 35 may be returned to the first position before the sheet is removed from between the four inkjet heads 2 and the conveyor surface 54.

Further, the above embodiment describes a case where there are two adjacent inkjet heads 2 without a moving mechanism 30 provided therebetween among the inkjet heads 2; however, there may be a moving mechanism 30 provided between every pair of adjacent inkjet heads 2.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording apparatus comprising:

one or more inkjet heads each having an ejection surface having a plurality of ejection openings formed thereon;

a conveyor mechanism which has a facing region facing the one or more ejection surfaces, and conveys a recording medium placed on the facing region;

one or more moving mechanisms each of which has a medium pusher pushing down a recording medium towards the facing region and causes the medium pusher to move between a first position and a second position, the first position being a position where a distance between the facing region and the medium pusher is farther than a distance between the facing region and the one or more ejection surfaces, and the second position being a position where the medium pusher contacts the facing region;

a jam detector which detects a sheet jam between the one or more inkjet heads and the conveyor mechanism; and a first movement controller which controls the one or more moving mechanisms to cause the one or more medium pushers to move from the first position to the second position, when the jam detector detects a sheet jam.

2. The inkjet recording apparatus according to claim 1, further comprising:

a suction mechanism that generates a suction force by which a recording medium placed on the facing region is adhered to the facing region; and a suction force controller which controls the magnitude of the suction force generated by the suction mechanism, wherein the suction force controller controls the suction mechanism so that the magnitude of the suction force generated is higher when the medium pusher is at the second position than when the medium pusher is at the first position.

3. The inkjet recording apparatus according to claim 1, further comprising:

a gap changing mechanism which changes a gap between the one or more inkjet heads and the facing region by moving one of the one or more inkjet heads and the facing region of the conveyor mechanism; and a gap controller which controls the gap changing mechanism, wherein the gap controller controls the gap changing mechanism so that the gap between the one or more inkjet heads and the facing region expands, after the one or more medium pushers move from the first position to the second position.

4. The inkjet recording apparatus according to claim 1, wherein the one or more medium pushers are one or more rollers each of which is rotatable on an axis parallel to the one or more ejection surfaces and perpendicular to a conveyance direction of a recording medium by the conveyor mechanism.

5. The inkjet recording apparatus according to claim 1, wherein the inkjet heads are aligned in the conveyance direction of a recording medium by the conveyor mechanism and the moving mechanisms are aligned in the conveyance direction of a recording medium by the conveyor mechanism so as to sandwich at least one of the inkjet heads, wherein there are at least one pair of adjacent inkjet heads where no moving mechanism is provided therebetween.

6. The inkjet recording apparatus according to claim 5, wherein four or more of the inkjet heads are aligned in the conveyance direction, and the moving mechanisms are provided, in the conveyance direction, only between the most upstream inkjet head and its adjacent inkjet head and between the most downstream inkjet head and its adjacent inkjet head.

7. The inkjet recording apparatus according to claim 1, further comprising:

a medium detector which detects presence/absence of a recording medium between the one or more inkjet heads and the conveyor mechanism; and a second movement controller which controls the one or more moving mechanisms so that when the one or more medium pushers are at the second position, portions of the one or more medium pushers each of which portion contacts the facing region are positioned between the ejection surfaces and the facing region until the presence of a recording medium is no longer detected by the medium detector.

8. An inkjet recording apparatus comprising:

one or more inkjet heads each having an ejection surface having a plurality of ejection openings formed thereon;

a facing portion which has a facing region facing the one or more ejection surfaces;

a conveyor mechanism configured to convey a recording medium to the facing region;

one or more moving mechanisms each of which has a medium pusher pushing down a recording medium towards the facing region and causes the medium pusher to move between a first position and a second position, the first position being a position where a distance between the facing region and the medium pusher is farther than a distance between the facing region and the one or more ejection surfaces, and the second position being a position where the medium pusher contacts the facing region;

a jam detector which detects a sheet jam between the one or more inkjet heads and the facing region; and a first movement controller which controls the one or more moving mechanisms to cause the one or more medium pushers to move from the first position to the second position, when the jam detector detects a sheet jam.

* * * * *